US006073375A

United States Patent [19]

Fant et al.

[11] Patent Number: 6,073,375

[45] Date of Patent: Jun. 13, 2000

[54] ADVERTISING DISPLAY SYSTEM FOR SLIDING PANEL DOORS

[76] Inventors: Patrick J. Fant, 6231 St. Andrews, Dallas, Tex. 76205; Dennis Sternitzsky, 7800 Caprock Dr., Plano, Tex. 75025; Kirsten A. Hayes, 3512 O'Malley Ct., Plano, Tex. 75023; William J. Froelich, 2716 Oats Dr., Plano, Tex. 75093

[21] Appl. No.: 09/304,868

[22] Filed: May 4, 1999

Related U.S. Application Data

[63] Continuation of application No. 08/878,019, Jun. 18, 1997, Pat. No. 5,918,441.

[51] Int. Cl.[7] ..... G09F 7/12

[52] U.S. Cl. ..... 40/594; 40/615; 49/120; 49/366

[58] Field of Search ..... 49/120, 366; 40/594, 40/615, 605, 638; D34/28

[56] References Cited

U.S. PATENT DOCUMENTS

| | | | |
|---|---|---|---|
| D. 272,533 | 2/1984 | Coons et al. . | |
| D. 284,778 | 7/1986 | Clifford et al. . | |
| D. 343,715 | 1/1994 | DeGrezia et al. | D99/1 |
| 567,012 | 9/1896 | Strong . | |
| 4,270,291 | 6/1981 | Babberi | 40/594 |
| 4,353,759 | 10/1982 | Stallings | 156/64 |
| 4,400,419 | 8/1983 | Laczynski | 428/41.3 |
| 5,263,529 | 11/1993 | Landis | 160/236 |

*Primary Examiner*—Terry Lee Melius
*Assistant Examiner*—James M Hewitt
*Attorney, Agent, or Firm*—Bracewell & Patterson, L.L.P.

[57] ABSTRACT

A display panel advertising system includes two halves, each adapted to be placed on one side of a two-panel elevator access door. As the door panels slide together and the elevator door closes, the two display panels begin to form a picture which is not completed until the door is fully closed. The picture or scene develops as it advances from a hidden view when the door is fully open and as the two halves approach one another. This creates an attention getting device wherein the passengers in the elevator are captive and actually have a place to focus their attention rather than on the ceiling or floor number panel. The display panel advertising system is an effective means of attracting attention and promoting products and services to selected consumers.

15 Claims, 3 Drawing Sheets

ADVERTISING DISPLAY SYSTEM FOR SLIDING PANEL DOORS

This application is a continuation of application Ser. No. 08/878,019 Jun. 18, 1997 U.S. Pat. No. 5,918,441.

BACKGROUND OF THE INVENTION

1. Field of the Invention

The subject invention is generally related to display advertising systems and is specifically directed to moving advertisement display panels for use on sliding panel doors.

2. Discussion of the Prior Art

Display advertising has been available for many years and generally comprises a poster or mural placed on a flat vertical surface such as a wall, billboard, side panel of a bus or the like. The purpose of the display is to catch the public's attention and promote a product or service through the use of the display. Whether or not such advertising is successful, its use is widespread.

The first purpose of the advertisement is to catch the attention of the target audience. When placed in public places, it is required that the target consumer's attention be diverted from other activities and toward the ad. For this reason such advertisements are often eye-catching, with the purpose of the ad being more subtle and sometimes almost hidden in the effort to attract the attention of the consumer.

It is desirable to place advertising in locations where the consumer and targeted audience has a high likelihood of noticing and reading the ad. It is also desirable to provide ads that increase the chance that the consumer will be drawn toward the ad by its appearance and content. For this reason, advertisements often have very eye-catching features, such as attractive models, bucolic scenes in an urban setting, bright colors and other attention getting features. One of the most successful ways to attract attention is to make the ad interactive or in motion. This is why television advertising is a desirable medium. It meets many requirements of the advertising objective, i.e., a captive audience, interactive and motion capability and the opportunity for special effects.

In general, display panel-type advertising does not have a high degree of effectiveness with respect to captive audience and motion diversion techniques which are considered to be highly successful advertising components.

Therefore, it is desirable to provide a display panel-type advertising system that has the advantages of being a low cost medium such as general panel-type ads of the prior art while increasing impact by improving the ability to attract a targeted audience and by increasing the interest in the ad by using at least limited dynamic interactive or motion techniques.

SUMMARY OF THE INVENTION

The display panel advertising system of the subject invention meets the desired criteria of placing the advertisement in view of a targeted, captive audience, using limited motion techniques to attract attention, while at the same time preserving the low cost advantages of know panel-type advertising systems when compared to print and television visual ads. In the preferred embodiment of the invention, the display panel system comprises two halves, each adapted to be placed on one side of a two-panel elevator access door. As the door panels slide together and the elevator door closes, the two display panels begin to form a picture which is not completed until the door is fully closed. The picture or scene develops as it advances from a hidden view when the door is fully open and as the two halves approach one another. This creates an attention getting action. In addition, the passengers in the elevator are captive and actually have a place to focus their attention rather than on the ceiling or floor number panel. The advertising system of the subject invention creates a very effective means of attracting attention and promoting products and services to selected consumers.

For example, hotel, rental car and local sights may be promoted this way in airports. Medical support services may be promoted in a hospital or medical clinic environment. Various goods and services available in a store might be promoted in a mall or store elevator. General purpose ads may be displayed in an office building, or specific services available in the building may be displayed.

One important feature of the display panel system of the subject invention is that it is relatively easy to install without damaging the original panel doors and is relatively tamper resistant. In the preferred embodiment, the mated, "inner" edges of the panels are placed against the center opening edges of the door panels, with the top comers in registration with one another. No other placement criteria is required. The display panels are printed on a thin, pliable sheet or membrane, usually one to four mils in thickness, and the back of each panel is coated with a heat sensitive adhesive. The panels may be mounted in place by applying low heat to the outer surface of each panel after it is positioned on the elevator door panel, with means such as a common hair-dryer or the like. Once positioned and mounted, the exposed edges of each display panel are sealed with a commercially available edge sealer to prevent peeling and to minimize tampering. The edge sealer is also heat sensitive.

In order to remove the ad, heat is applied using the same heater, e.g., common hair-dryer, to release the adhesive and edge seal. It is also possible to place additional display panels over the top of previously mounted panels.

The display panel advertising system of the present invention does not require any modification of the typical elevator door panel and does not damage the door panel in any manner. The panels may be of uniform size, and where the elevator door panel is too narrow to accommodate the full display panel, the "outer" edges of the panel may be trimmed to size using an Exacto-type knife or scissors.

The display panels may be transported in a rolled-up condition in a tube, or simply bundled with ties.

It is, therefore, an object and feature of the subject invention to provide a display panel advertising system that uses motion as an eye-catching mechanism, utilizing the dynamic interaction or involvement between the consumer and the ad to attract attention.

It is also an object and feature of the subject invention to provide a display panel advertising system that is directed to a targeted, captive audience.

It is a further object and feature of the subject invention to provide a display panel advertising system that may be placed on finished panels of a door system without damage to the door surfaces.

It is another object and feature of the subject invention to provide a display panel advertising system that is relatively tamper resistant once installed, yet is easily removed without damage to the surface upon which it is mounted.

Other objects and features of the invention will be readily apparent from the accompanying drawings and detailed description of the preferred embodiments.

DETAILED DESCRIPTION OF THE PREFERRED EMBODIMENT

Figure 1C:
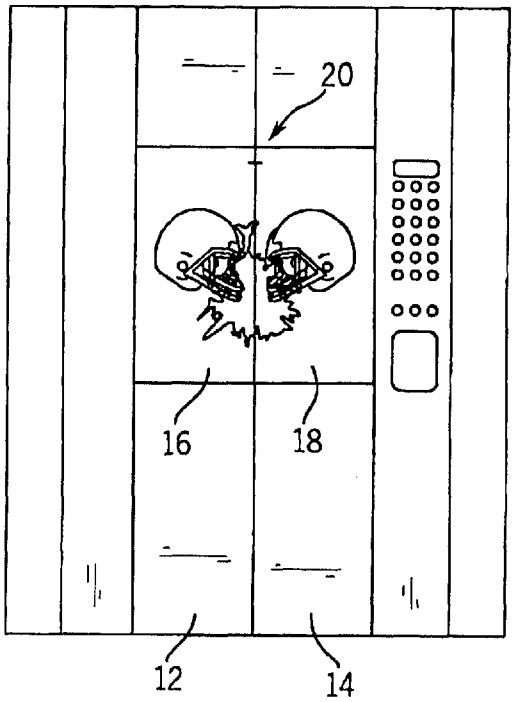
FIGS. 1*a*, 1*b* and 1*c* are sequential views of a first installed ad panel series.
Figure 1B:
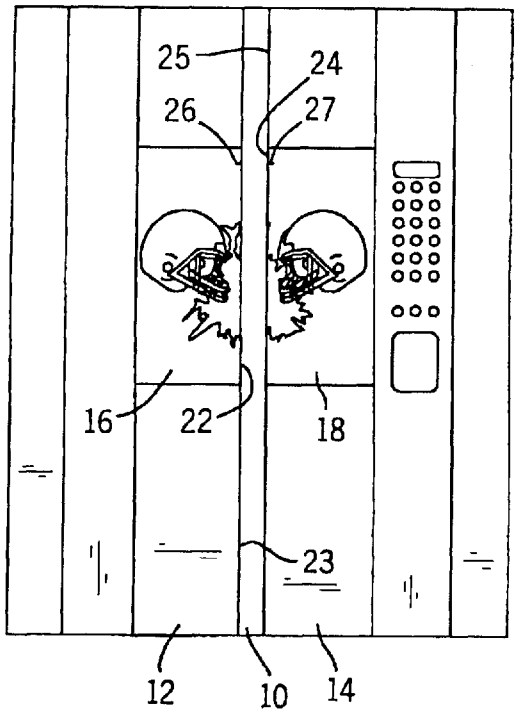
Figure 1A:
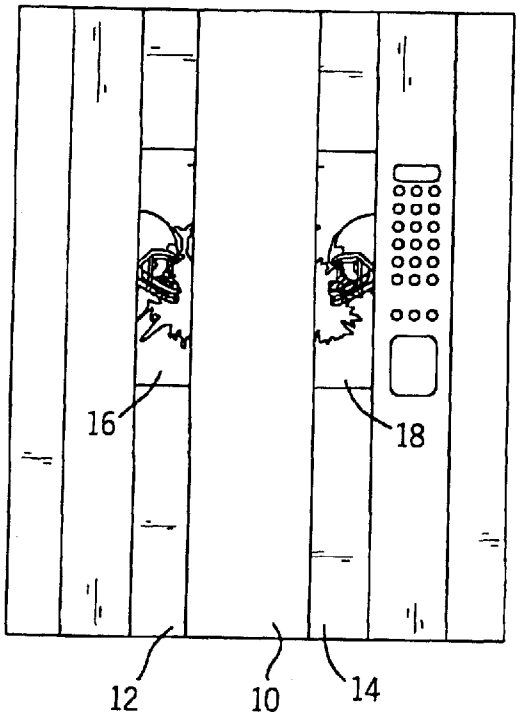
Figure 4:
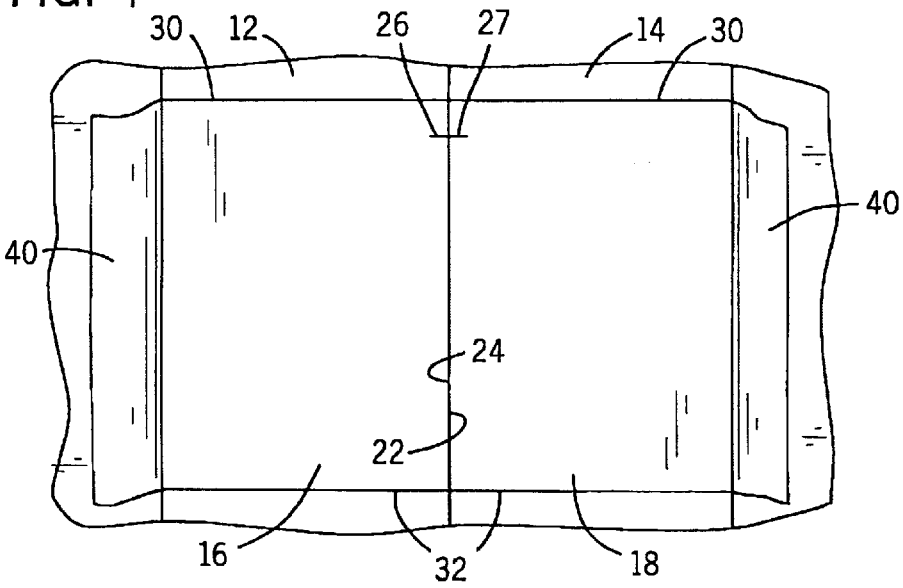
FIG. 4 is a perspective view of a closed elevator door system, showing placement of the mated edges and registration comers.

A first panel series is shown if FIGS. 1*a,* 1*b* and 1*c* and depicts the sequential development of the ad as the elevator doors slide closed. As there shown, a typical elevator cab interior 10 is gained accessed through opposed sliding panel doors 12 and 14. Turning first to FIG. 1*c,* the ad copy is mounted on two mated halfpanels 16 and 18, which when placed in registered, mated, juxtaposed relationship, form a complete ad 20. As best shown in FIG. 4, the two ad panels 16 and 18 are positioned on the surface of doors 16 and 18 by positioning one half panel 16 on closed door 12, with the mating edge 22 along the edge 23 of the door panel. A registration mark 26 is near the top corner of the panel 16 and extends to edge 22. Once the panel 16 is positioned in place on the door, the panel is secured by adhesive to the door panel. The second half panel 18 is then positioned to mate with panel 16 by matching the registration mark 27 of panel 18 with the registration mark 26 of panel 16 and placing the mating edge 24 along the door panel edge 25 of door panel 14. The second panel is then adhesively secured to the surface of the door panel 14.

The resulting panel display is a dynamic, interactive ad placed where it will reach a targeted, captive audience. As shown in FIGS. 1*a,* 1*b* and 1*c,* the ad will be completely hidden from view when the elevator doors are fully open. As the doors close, a scene will begin to unfold, catching the passenger's eye. As the doors continue to close, the scene is completed, with the passenger dynamically involved in the development of the message.

Figure 2C:
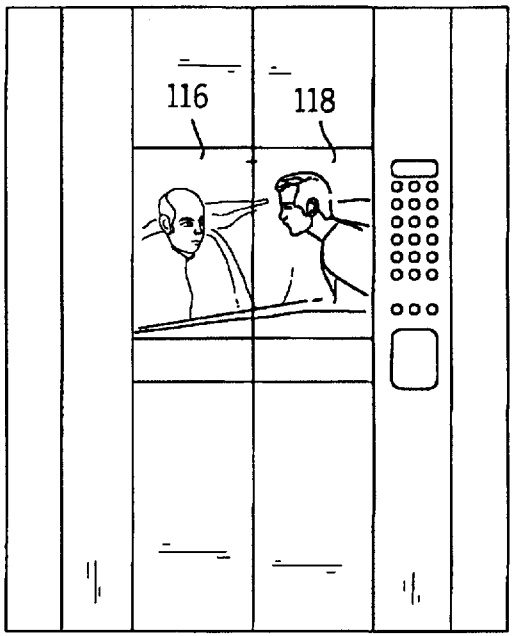
FIGS. 2*a,* 2*b* and 2*c* are sequential views of a second installed ad panel series.
Figure 2B:
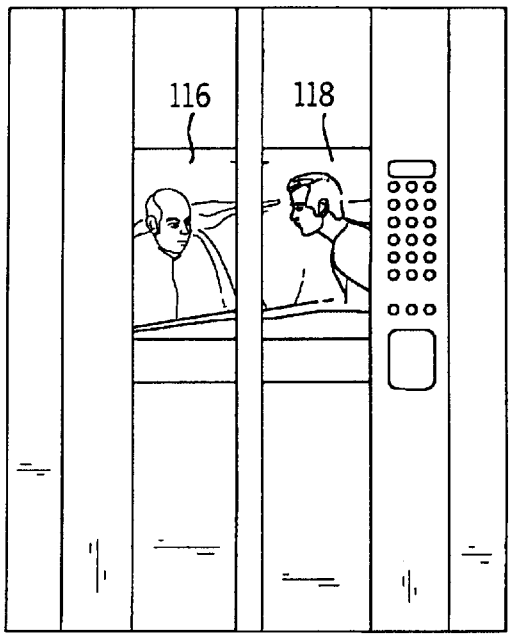
Figure 2A:
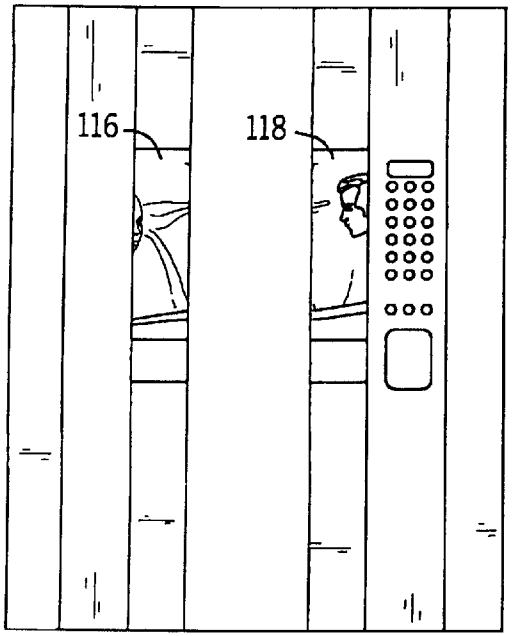

An even more dramatic example is shown in FIGS. 2*a,* 2*b* and 2*c.* As there shown, when the panels 116 and 118 are in the nearly filly open position the final scene is hard to depict. As the doors close and the scene unfolds, the message begins to evolve with the final picture and message not being clear until the doors are fully closed in FIG. 2*c.*

Figure 3:
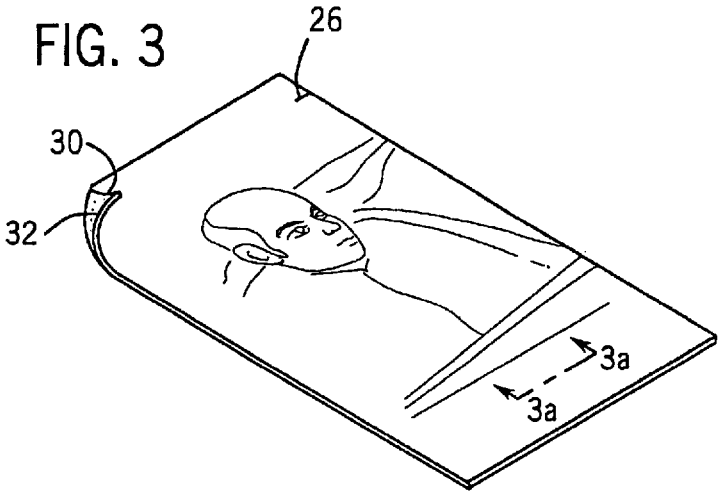
FIG. 3 is a perspective view of a panel with one corner rolled over to expose the adhesive backed edge.
Figure 3A:
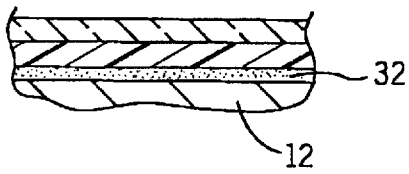
FIG. 3*a* is a fragmentary cross-sectional view of looking in the direction of arrows 3*a* in FIG. 3 and showing the laminated layers of material of the display ad.

The ad panel 16 is shown prior to mounting in FIG. 3. The upper left corner 30 has been rolled over to show the back surface 32 of the panel. The registration mark 26 is clearly depicted in the upper right hand corner. In the preferred embodiment, each panel of an underlayment or substrate is made of a pliable film product such as, by way of example 3M® Scotchprint Premium Marking Films Series 8600. The film is a white, 4 mil system film for application to flat surfaces, and includes a proprietary 3M® heat sensitive adhesive which is activated by applying heat to the untreated or front surface of approximately 100° F. (38° C.) after the film has been placed against the flat surface. The white front surface of the panel may be printed in a standard, well know manner prior to application. In the preferred embodiment an over layer is laminated over the substrate, for example a 3M® Scocthprint Overlaminate Film Series 8945 series film, for providing a protective scratch resistant or graffiti resistant front surface.

The mated panel 18 will have identical features, with a mated edge 24 adapted to abut against mated edge 22 of panel 16 and registration marks 26 and 27 properly aligned to provide the completed panel display advertisement, as is best shown in FIG. 4.

Figure 5:
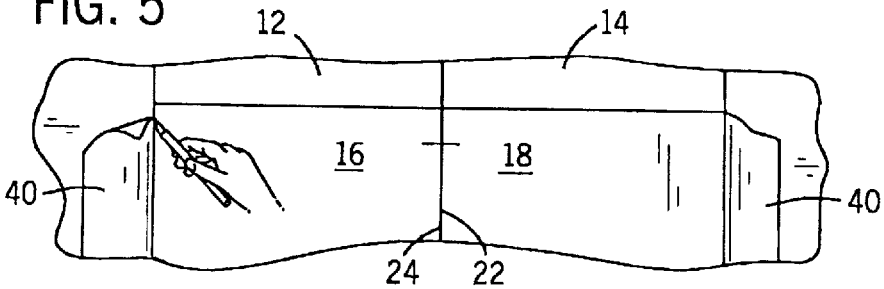
FIG. 5 is a view similar to FIG. 4, showing trimming of the outer edges of the panels to fit the elevator door panels.

As shown in FIG. 5, if the ad panels 16 and 18 are wider than the elevator door panels 12 and 14, respectively, the outer or free edge 40 of each panel 16, 18 may be trimmed to fit with an Exacto-type knife after application, or even with scissors before application.

Once installed on the door panels, the outer exposed upper and lower edges 30, 32 of each panel, the exposed mating edges 24 and 26 and the finished free edge 40 are all sealed using a commercial edge sealer such as, by way of example, 3M® Scotchcal Edge Sealer 3950, which is also heat activated.

The final display ad is an attractive, dynamic, interactive advertisement which is presented to a targeted, captive audience. The ads are both eye-catching and compelling. The dynamic involvement of the opening and closing elevator doors lends a new dimension to the design of heretofore static display panel advertising. While certain features and embodiments of the invention have been described in detail herein, it will be understood that the invention includes all of the enhancements and modifications within the scope and spirit of the following claims.

What is claimed is:

1. A display panel advertising message system for defining a dynamic advertisement on a flat mounting surface, the advertising message adapted to develop into a completed message as two separate mounting surfaces each having a panel thereon, are moved from a spaced apart position to a juxtaposed, abutting position wherein advertising copy is developed and defined by movement of the mounting surfaces, the advertising system comprising:

a. a first panel having a first portion of advertising copy applied to a surface thereof; the first panel being mounted on a first mounting surface which is adapted for longitudinal movement;

b. a second panel having a second portion of advertising copy applied to a surface thereof; the second panel being mounted on a second mounting surface which is adapted for longitudinal movement;

c. each of said panels having a mating edge, whereby the two panels may be placed in juxtaposed, abutting relationship along the respective mating edges as the two mounting surfaces are longitudinally moved from a spaced apart position to a juxtaposed, abutting position; and d. a registration marking on each panel intersecting the mating edge thereof such that the panels may be properly registered with one another, the advertising copy designed such that a visual image is created as the two mounting surfaces are slidably moved from a position wherein the mated edges are separated by a space to a position wherein the mated edges are in abutting relationship.

2. The advertising system of claim 1, wherein the advertising copy is placed on a front surface of each panel and wherein each panel further includes a back surface and an adhesive backing is applied to the back surface.

3. The advertising system of claim 2, wherein the adhesive backing is heat sensitive and is adapted to be activated by applying heat to the front surface after the back surface has been placed against a flat mounting surface.

4. The advertising system of claim 3, wherein the adhesive backing may be activated by applying heated air heated to approximately 100° F. to the front surface of each panel.

5. The advertising system of claim 1, wherein each panel is constructed of a pliable underlayment or substrate membrane of from 1 to 4 mils in thickness.

6. The advertising system of claim 1, wherein each panel is constructed of a first underlayment layer upon which the advertising copy is printed and a second, overlaying layer for providing a protective covering over the advertising copy.

7. The advertising system of claim 1, wherein each of said first and second panels includes a peripheral edge which is exposed once each of said panels is mounted on their mounting surfaces and wherein there is further included an edge sealer which is activated once each of said panels is mounted.

8. The advertising system of claim 1, wherein each panel includes a peripheral edge, at least a portion of which may be trimmed to fit the flat mounting surface without disturbing the advertising copy.

9. A method for mounting a dynamic display panel advertisement in an elevator, the method comprising the steps of:

a. placing one panel of a pair of panels on a surface of one side of a sliding elevator door;

b. placing another panel of the pair of panels on a surface of one side of a mating sliding elevator door;

c. mounting each panel to the surface of the respective elevator door sides such that said panels form a completed image when said doors are moved to a closed position.

10. The method of claim 9, wherein each of said panels is printed with ad copy prior to step "a" and thereafter there is included the step of laminating a protective layer over the ad copy.

11. The method of claim 9, wherein each panel has a front surface and is mounted to the respective side of the elevator door by applying heat to the front surface of each panel after each panel has been placed on the respective door side.

12. The method of claim 9, further including aligning the panels with one another prior to step c.

13. The method of claim 9, further including the step of trimming the panels to fit each said surface of said elevator door without disturbing the advertising copy.

14. The method of claim 9, wherein each panel has a peripheral edge and further including the step of sealing the peripheral edge of each panel of the pair of panels after step c.

15. The method of claim 9, wherein each panel of said pair of panels is mounted to the surface of the respective elevator door sides with an adhesive.

* * * * *